US007134286B2

(12) United States Patent
Markarian et al.

(10) Patent No.: US 7,134,286 B2
(45) **Date of Patent: *Nov. 14, 2006**

(54) GAS TURBINE FLOATING COLLAR ARRANGEMENT

(75) Inventors: Lorin Markarian, Etobicoke (CA); Bhawan Bhai Patel, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 113 days.

This patent is subject to a terminal disclaimer.

(21) Appl. No.: 10/924,208

(22) Filed: Aug. 24, 2004

(65) Prior Publication Data

US 2006/0042268 A1 Mar. 2, 2006

(51) Int. Cl.
*F02C 7/20* (2006.01)

(52) U.S. Cl. ..... 60/796; 60/800

(58) Field of Classification Search ..... 60/796, 60/798, 799, 800, 740, 804
See application file for complete search history.

(56) References Cited

U.S. PATENT DOCUMENTS

| | | | | |
|---|---|---|---|---|
| 3,939,653 | A | 2/1976 | Schirmer | |
| 3,972,182 | A * | 8/1976 | Salvi | 60/743 |
| 4,195,476 | A | 4/1980 | Wood | |
| 4,322,945 | A | 4/1982 | Peterson et al. | |
| 4,365,470 | A | 12/1982 | Matthews et al. | |
| 4,454,711 | A | 6/1984 | Ben-Porat | |
| 4,458,479 | A * | 7/1984 | Reider et al. | 60/800 |
| 4,606,190 | A | 8/1986 | Greene et al. | |
| 4,686,823 | A | 8/1987 | Coburn et al. | |
| 4,748,806 | A | 6/1988 | Drobny | |
| 4,870,818 | A * | 10/1989 | Suliga | 60/740 |
| 4,914,918 | A * | 4/1990 | Sullivan | 60/756 |
| 4,934,145 | A * | 6/1990 | Zeisser | 60/756 |
| 4,999,996 | A | 3/1991 | Duchene et al. | |
| 5,117,624 | A | 6/1992 | Roberts, Jr. et al. | |
| 5,172,545 | A * | 12/1992 | Forestier | 60/800 |
| 5,220,786 | A | 6/1993 | Campbell | |
| 5,222,358 | A | 6/1993 | Chaput et al. | |
| 5,239,832 | A * | 8/1993 | Koshoffer et al. | 60/740 |
| 5,253,471 | A * | 10/1993 | Richardson | 60/804 |
| 5,265,409 | A | 11/1993 | Smith, Jr. et al. | |
| 5,271,219 | A | 12/1993 | Richardson | |
| 5,274,991 | A | 1/1994 | Fitts | |
| 5,323,601 | A | 6/1994 | Jarrell et al. | |
| 5,435,139 | A | 7/1995 | Pidcock et al. | |
| 5,501,071 | A | 3/1996 | Ansart et al. | |
| 5,509,270 | A | 4/1996 | Pearce et al. | |
| 5,533,330 | A * | 7/1996 | Mullooly et al. | 60/799 |
| 5,542,246 | A * | 8/1996 | Johnson et al. | 60/804 |
| 5,577,379 | A * | 11/1996 | Johnson | 60/796 |
| 5,758,503 | A | 6/1998 | DuBell et al. | |
| 5,894,732 | A | 4/1999 | Kwan | |
| 5,916,142 | A | 6/1999 | Snyder et al. | |
| 5,924,288 | A | 7/1999 | Fortuna et al. | |
| 5,974,805 | A | 11/1999 | Allen | |
| 5,996,335 | A | 12/1999 | Ebel | |
| 6,351,949 | B1 | 3/2002 | Rice et al. | |
| 6,427,435 | B1 | 8/2002 | Patterson et al. | |
| 6,453,675 | B1 | 9/2002 | Royle | |

(Continued)

*Primary Examiner*—William H. Rodriguez
(74) *Attorney, Agent, or Firm*—Ogilvy Renault LLP

(57) ABSTRACT

A simplified floating collar mounting arrangement for receiving a fuel nozzle swirler body of a gas turbine engine combustor is provided. The assembly comprises a floating collar mounted between a spaced-apart mounting flange and cap, and slidably trapped therebetween such that relative radial movement is permitted. The arrangement offers reduced part count and simplicity, and therefore improves reliability.

7 Claims, 4 Drawing Sheets

U.S. PATENT DOCUMENTS 6,497,105 B1 12/2002 Stastny
6,502,400 B1 * 1/2003 Freidauer et al. ..... 60/772
6,880,341 B1 * 4/2005 Parkman et al. ..... 60/740
2004/0006995 A1 * 1/2004 Snyder ..... 60/796

* cited by examiner

GAS TURBINE FLOATING COLLAR ARRANGEMENT

CROSS-REFERENCE TO RELATED APPLICATIONS

This application relates to U.S. Patent Application Publication No. US 2006/0042269, filed Aug. 24, 2004, the specification of which is incorporated herein by reference.

TECHNICAL FIELD

The invention relates generally to gas turbine engine combustors and, more particularly, to a floating collar arrangement therefor.

BACKGROUND OF THE ART

Gas turbine combustors are typically provided with floating collars or seals to permit relative radial or lateral motion between the combustor and the fuel nozzle while minimizing leakage therebetween. The collar is subject to wear and heat, and is therefore cast/machined form a heat resistant material. As fuel nozzles, combustors and related components must be periodically removed for cleaning, inspection, repair and, occasionally replacement, the floating collar arrangement is provided in a manner which facilitates such removal, to thereby facilitate maintenance. Floating collar arrangements have become quite elaborate in the recent art, as designers continuously improve gas turbine efficiency. Such improvement, however, often comes at the expense of economical operation for the operator, as elaborate parts are typically more expensive to repair and replace. Accordingly, there is a need to provide a solution which addresses these and other limitations of the prior art, and in particular, there is a need to provided economical solutions to enable the emerging general aviation very small turbofan gas turbine market.

SUMMARY OF THE INVENTION

In one aspect, the present invention provides a gas turbine combustor floating collar assembly for receiving a fuel nozzle swirler body, the combustor having a nozzle opening defined in a dome thereof, the swirler body having an abutment shoulder extending therearound, the assembly comprising a mounting arrangement including a mounting flange spaced apart from the dome and circumscribing the opening, the flange fixedly bonded to the dome, and a cap spaced apart in an axial direction relative to the combustor from the mounting flange, the cap fixedly bonded to the mounting flange; and a floating collar slidably trapped between the mounting flange and the cap such that relative axial movement is substantially restrained but relative radial movement is permitted, the collar having a central aperture alignable with the dome opening and adapted for axial sliding engagement with the nozzle body, wherein the floating collar cannot be released from the mounting arrangement and the mounting arrangement cannot be released from the combustor without damaging at least one of the combustor, the mounting arrangement and the floating collar.

In another aspect, the present invention provides a method of providing a floating collar assembly on a gas turbine engine, the method comprising the steps of providing an assembly having a combustor with a nozzle opening defined in a dome thereof, a mounting arrangement including a sheet metal mounting flange, a sheet metal cap, and a sheet metal floating collar, the mounting flange, cap and floating collar each having a central aperture alignable with the dome opening, the floating collar aperture adapted for axial sliding engagement with a fuel nozzle air swirler body; fixedly bonding the mounting flange to the combustor dome in a spaced apart manner such that the flange central opening is generally aligned with dome opening; inserting the floating collar into the mounting flange; and fixedly bonding the cap to the mounting flange to thereby slidingly trap the floating collar between cap and the mounting flange.

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
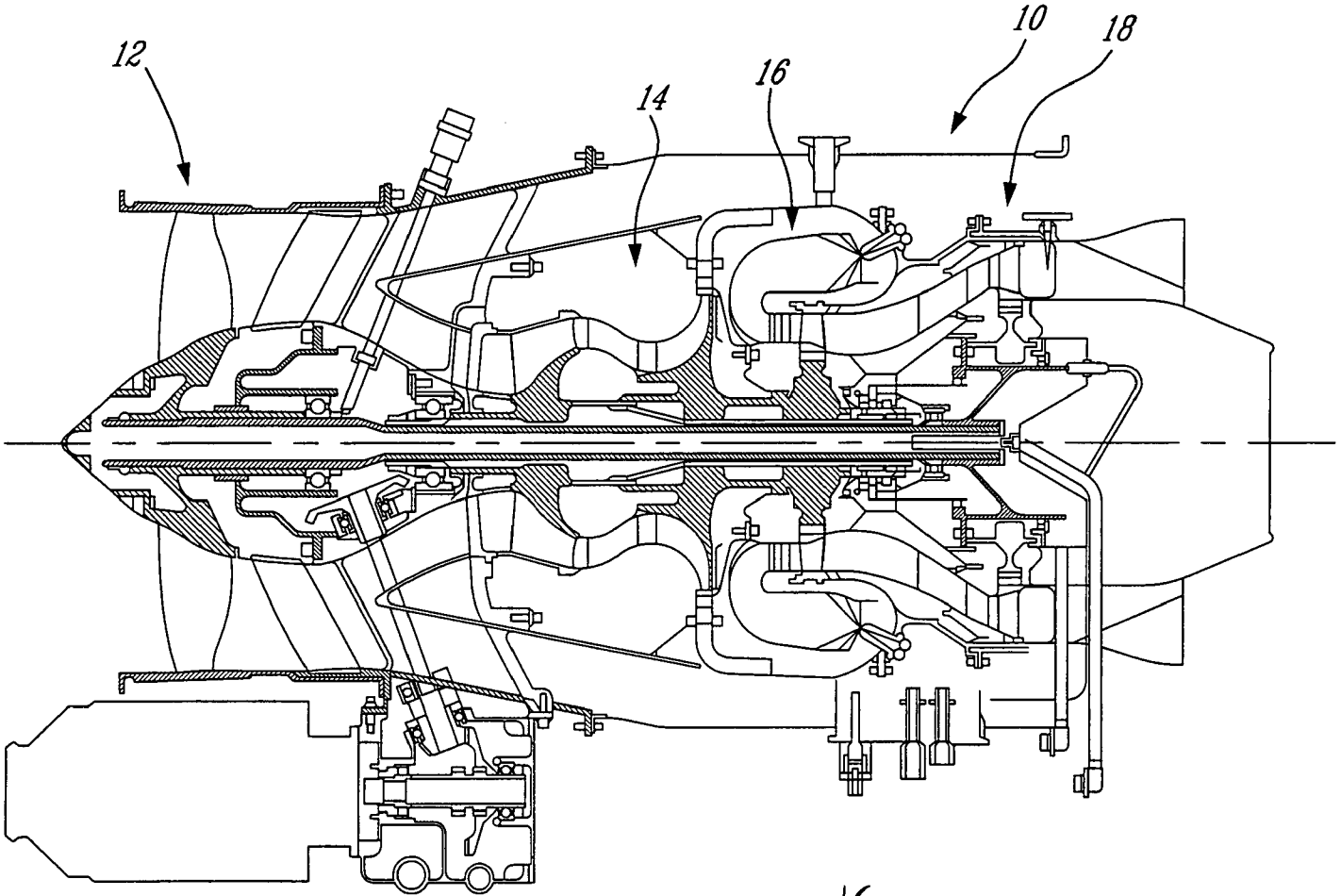
FIG. 1 is a schematic longitudinal sectional view of a turbofan gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
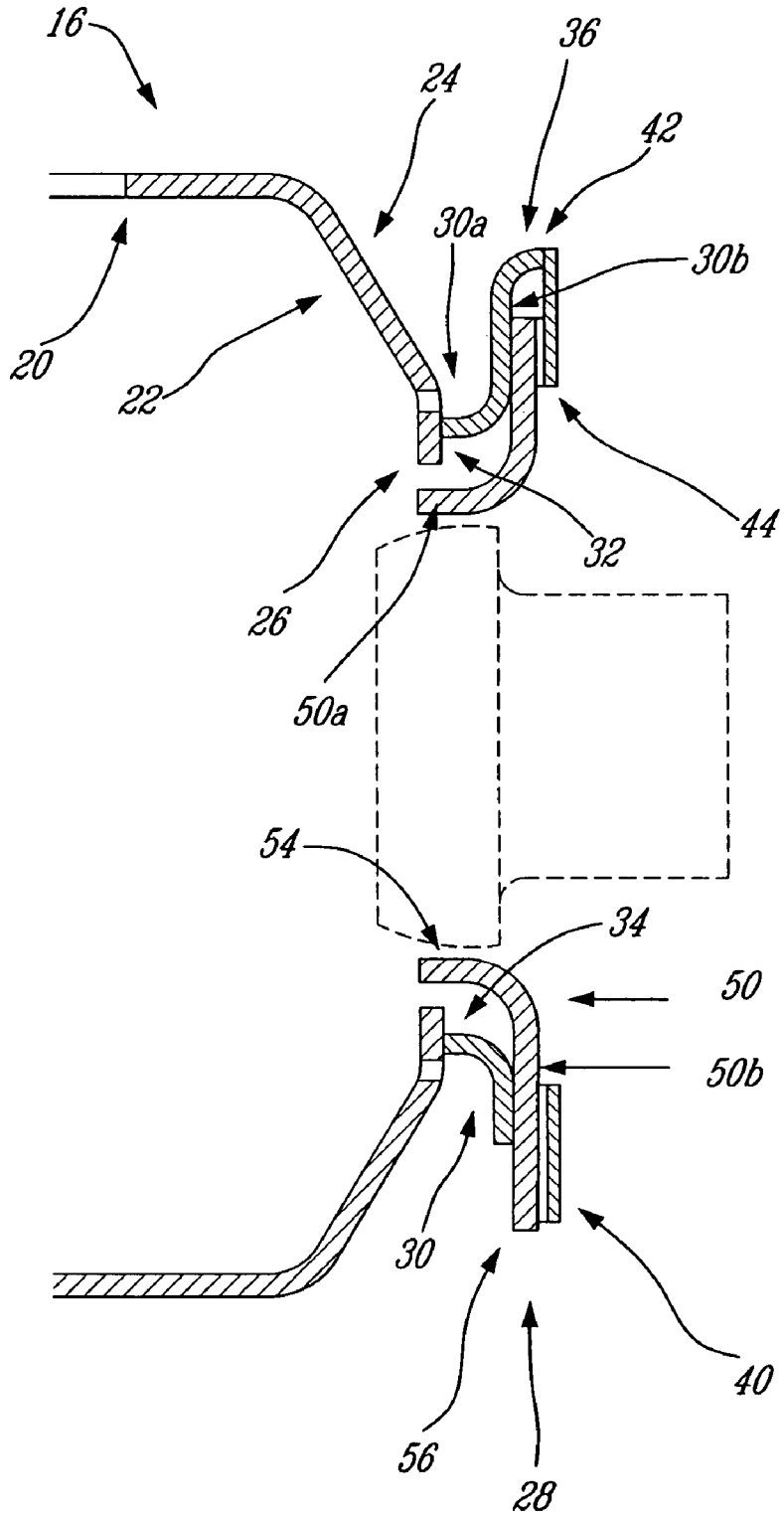
FIG. 2 is a partial sectional view of a combustor in accordance with an embodiment of the present invention.
Figure 3:
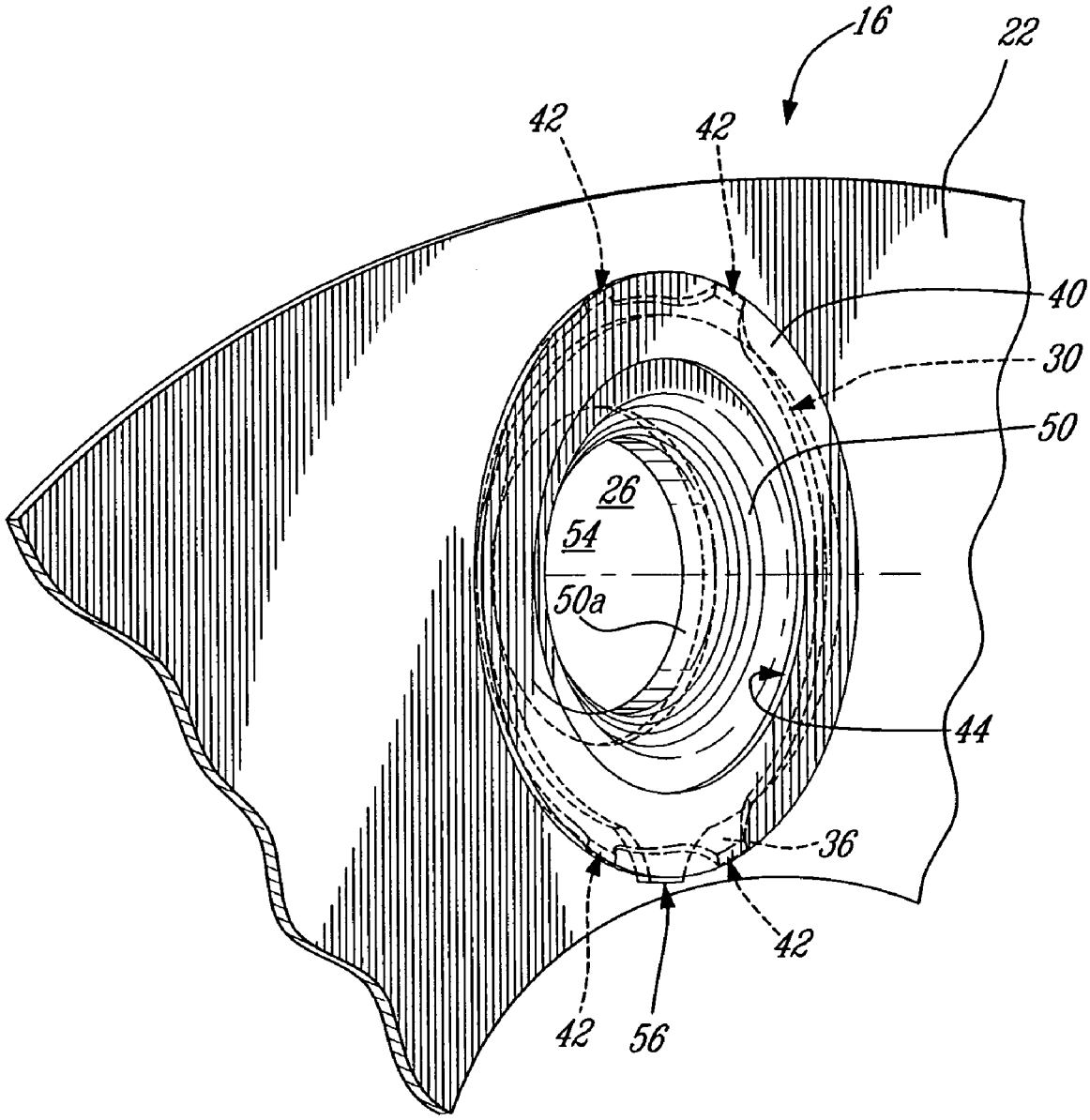
FIG. 3 is an isometric view of a portion of FIG. 2.

FIG. 2 shows an enlarged axial sectional view of a combustor 16 having a liner 20 and a dome 22 having an exterior side 24 and a central opening 26 for receiving a air swirler fuel nozzle (depicted in stippled lines in FIG. 2) of the type generally described in U.S. Pat. Nos. 6,289,676 or 6,082,113, for example, and which are incorporated herein by reference. A mounting arrangement 28 is provided as will now be described.

An annular mounting flange 30 is fixedly bonded, preferably by a weld 32, to the exterior side 24 of dome 22, and includes an axially-disposed annular portion 30*a*, a radially disposed annular flange portion 30*b*, both defining a central aperture 34 therein. Central aperture 44 can be aligned with dome opening 26 when mounting flange 30 is mounted on the combustor. Mounting flange 30 may also include a plurality of legs 36 as will be described further below.

An annular cap 40 is provided and fixedly bonded, preferably by a weld 42, to mounting flange 30, preferably at legs 36. Cap is provided in a spaced-apart manner relative to mounting flange 30, as will be described further below. Cap 40 has a central aperture 44 which is aligned with dome opening 26 when mounted on combustor 16 and adapted to receive the fuel nozzle therein.

A floating collar 50 is provided having a axially-disposed nozzle collar portion 50*a*, and a radially disposed annular flange portion 50*b*, both surrounding a central aperture 54, and a smooth transition 50*c* joins portions 50*a* and 50*b*. Central aperture 54 and collar portion 50*a* are provided for axially slidingly engaging a circumferential shoulder of the fuel nozzle swirler body (stippled lines in FIG. 2). Collar portion 50*a* preferably extends to, or inside, dome 22 though opening 26. Flange portion 50*b* is trapped between opposed surfaces of mounting flange 30 and cap 40, with mounting flange 30 and cap 40 being sufficiently spaced apart to permit radial (relative to the engine axis of FIG. 1) sliding motion to occur between floating collar 50 and mounting flange 30/cap 40. An anti-rotation tang 56 depends from flange portion 50*b* and is likewise trapped between adjacent mounting flange legs 36, to thereby limit the amount by which floating collar 50 may rotate relative to mounting flange 30/cap 40.

In use, the fuel nozzle air swirler (not shown) is positioned within central aperture 54 and delivers a fuel air mixture to combustor 16. As forces acting upon the fuel nozzle and the combustor tend to cause relative movement therebetween, floating collar 50 is able to displace radially with the nozzle while maintaining sealing with respect to combustor through maintaining sliding engagement with mounting flange 30 and cap 40. Welds 32 and 42 ensure that mounting flange 30 and cap 40 maintain their spaced-apart relation and thereby keep floating collar 50 trapped therebetween.

Figure 4:
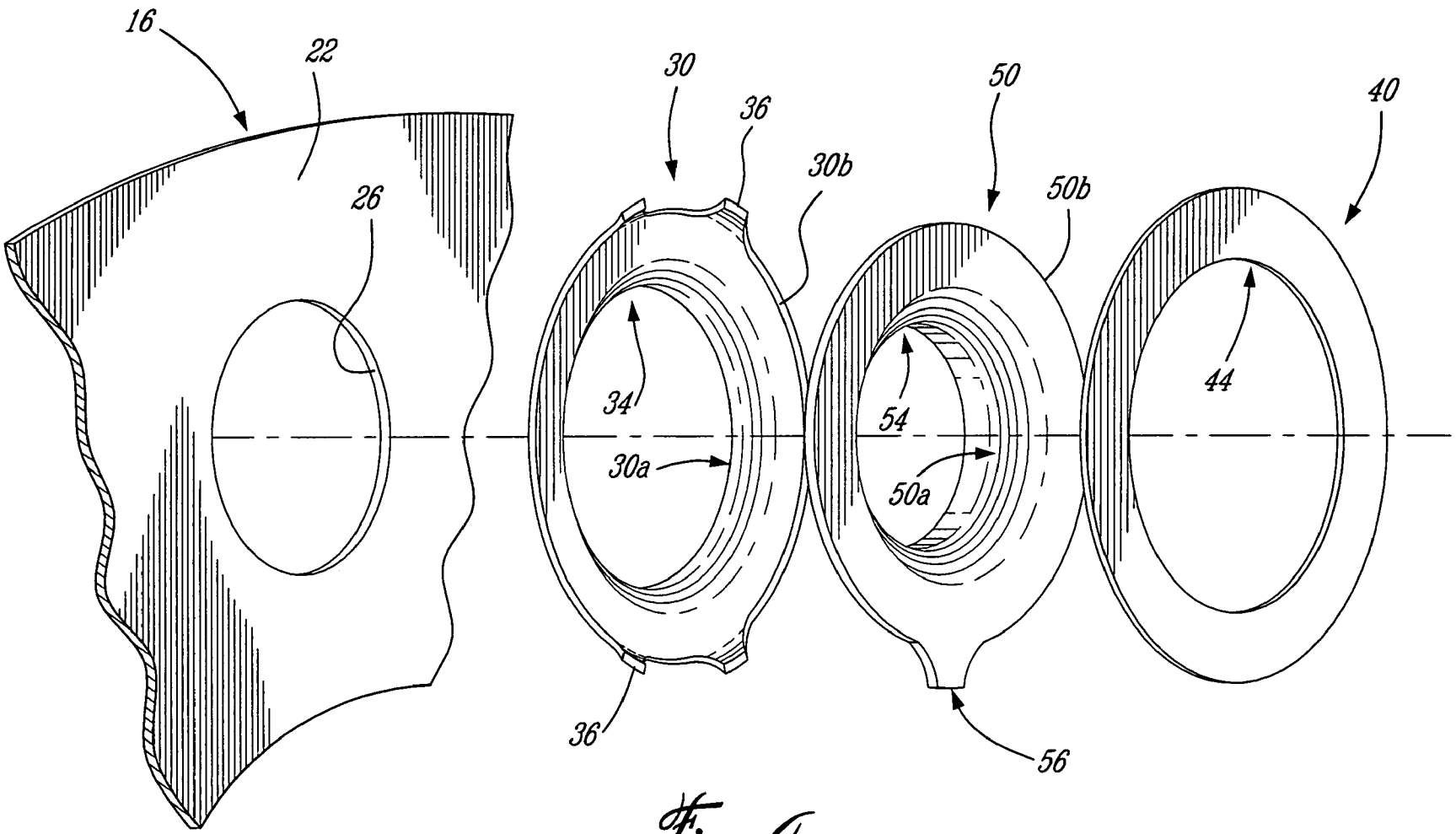
FIG. 4 is an exploded isometric view of FIG. 3.

Referring to FIG. 4, mounting arrangement 28 is assembled through a process involving at least the following steps: welding mounting flange 30 to combustor dome 22 so that the flange central opening 36 is generally aligned with dome opening 26; inserting floating collar 50 into the mounting flange 30, so that the collar portion 50*a* extends through central opening 36 and is generally aligned with dome opening 26, and preferably also so that anti-rotation tang 56 is trapped between two closely adjacent legs 36; and welding cap 40 to mounting flange 30, preferably at legs 36, to slidingly trap the floating collar between cap and the mounting flange. The order of operations may be any suitable, and need not be chronologically as described.

Mounting arrangement 28 and floating collar 50 are preferably provided from sheet metal using a suitable fabrication process. An simplified example process is to provide a sheet of metal, cut a blank, and perform at least one bending operation to provide the floating collar. Referring again to FIG. 2, it is evident that a sheet metal collar 50 has a continuous transition 50*c* is provided as a result of a sheet metal forming operation, such a bending, and helps strengthen the collar 50. Unlike prior art collars made by investment casting and/or machining processes (see U.S. Pat. Nos. 4,454,711, 4,322,945 and 6,497,105, for example), the present invention's use of sheet metal advantageously permits a very light weight and inexpensively-provided part, due to its simple geometry, and yet provides good performance and reliability.

Unlike the prior art, the mounting assembly of the present invention is geometrically simple, lightweight, easy to manufacture and east to assemble. Contrary to the prior art which teaches providing a high-cost device which facilitates replacement, the design and method of the present invention instead has relatively low initial cost, which assists in providing a lower-overall cost to the gas turbine engine, thereby facilitating the provision of an affordable general aviation turbofan engine, for example. As well, because the initial cost is lower, the cost of replacement may also be lowered.

The above description is meant to be exemplary only, and one skilled in the art will recognize that changes may be made to the embodiments described without departing from the scope of the invention disclosed. For example, the present invention may be applied to any gas turbine engine, and is particularly suitable for airborne gas turbine applications. The means by which flange 30 is mounted to cap 40 may be different than that described. For example legs 36 may be replaced or supplemented with a continuous or discontinuous flange or lip, and/or may extend from flange 30, cap 40 or both. The mode of anti-rotation may be any desirable. Though welding is preferred, brazing or other bonding methods may be used. Other modifications which fall within the scope of the present invention will be apparent to those skilled in the art, in light of a review of this disclosure, and such modifications are intended to fall within the equivalents accorded to the appended claims.

The invention claimed is:

1. A gas turbine combustor floating collar assembly for receiving a fuel nozzle swirler body, the combustor having a nozzle opening defined in a dome thereof, the swirler body having an abutment shoulder extending therearound, the assembly comprising:

a mounting arrangement including a mounting flange spaced apart from the dome and circumscribing the opening, the flange fixedly bonded to the dome, and a cap spaced apart in an axial direction relative to the combustor from the mounting flange, the cap fixedly bonded to the mounting flange; and a floating collar slidably trapped between the mounting flange and the cap such that relative axial movement is substantially restrained but relative radial movement is permitted, the collar having a central aperture alignable with the dome opening and adapted for axial sliding engagement with the nozzle body, wherein the floating collar cannot be released from the mounting arrangement and the mounting arrangement cannot be released from the combustor without damaging at least one of the combustor, the mounting arrangement and the floating collar.

2. The assembly of claim 1 wherein the flange is disposed exterior of the dome.

3. The assembly of claim 2 wherein the flange is disposed immediately adjacent the dome.

4. The assembly of claim 1 wherein the flange and the cap are separated only by the floating collar.

5. A method of providing a floating collar assembly on a gas turbine engine, the method comprising the steps of:

providing an assembly having a combustor with a nozzle opening defined in a dome thereof, a mounting arrangement including a mounting flange, a cap, and a floating collar, the mounting flange, cap and floating collar each having a central aperture alignable with the dome opening, the floating collar aperture, adapted for axial sliding engagement with a fuel nozzle air swirler body;

fixedly bonding the mounting flange to the combustor dome in a spaced apart manner such that the flange central opening is generally aligned with the dome opening;

inserting the floating collar into the mounting flange; and fixedly bonding the cap to the mounting flange to thereby slidingly trap the floating collar between the cap and the mounting flange.

6. The method of claim 5 wherein the step of providing the floating collar comprises at least the steps of providing a sheet of metal, cutting a blank and performing at least one bending step on the blank to form the floating collar.

7. The method of claim 6 wherein the step of bending including bending the blank to provide a floating collar having an axial extending annular collar portion, an annular flange portion extending radially from the collar portion and a smooth transition portion between the collar and flange portions.

* * * * *